US005414929A

United States Patent [19]

Flöser et al.

[11] Patent Number: 5,414,929

[45] Date of Patent: May 16, 1995

[54] METHOD OF PRODUCING A TURBINE ROTOR

[75] Inventors: Bernhard Flöser, Wendelstein; Bernhard Herold, Stein; Peter Kerber, Schwabach, all of Germany

[73] Assignee: ABB Patent GmbH, Mannheim, Germany

[21] Appl. No.: 158,688

[22] Filed: Nov. 26, 1993

[30] Foreign Application Priority Data

Nov. 26, 1992 [DE] Germany ..... 42 39 710.3

[51] Int. Cl.[6] ..... B23P 15/00

[52] U.S. Cl. ..... 29/889.21; 29/889; 416/198 R

[58] Field of Search ..... 29/889.2, 889.21, 889; 416/198 R

[56] References Cited

U.S. PATENT DOCUMENTS

| | | | |
|---|---|---|---|
| 4,060,883 | 12/1977 | Coulon | 29/889.2 |
| 4,086,690 | 5/1978 | Bernasconi | 416/213 |
| 4,581,816 | 4/1986 | Klufas et al. | 29/889.2 |
| 4,628,575 | 12/1986 | Klufas et al. | 29/889.2 |
| 4,715,524 | 12/1987 | Fukaya et al. . | |
| 4,743,165 | 5/1988 | Ulrich | 416/198 |
| 4,893,388 | 1/1990 | Amos et al. | 29/889.2 |
| 4,962,586 | 10/1990 | Clark et al. | 29/889.2 |
| 5,267,397 | 12/1993 | Wilcox | 29/889.2 |

FOREIGN PATENT DOCUMENTS

| | | |
|---|---|---|
| 1025422 | 3/1958 | Germany . |
| 2235961 | 3/1973 | Germany . |
| 1426799 | 7/1973 | Germany . |
| 2522277 | 12/1975 | Germany . |
| 3813860 | 11/1989 | Germany . |

*Primary Examiner*—Irene Cuda

[57] ABSTRACT

A method for producing a rotor of a turbine, particularly a steam turbine, from individual rotor parts being welded together to make a unit, includes assembling parts of a rotor required for a given turbine in a modular system having supply steam shaft ends, single rotor disks, double rotor disks, exhaust steam shaft ends and optionally condensation-end-stage drums, for producing various rotor variants. The parts of the rotor are produced at parallel times according to orders and/or taken from stock. Still required remachining of the assembled rotor during production of the parts, especially machining grooves in final form for receiving rotor blade roots in the remachining step, is minimized. The parts are joined together with low warping with a beam of high power density, preferably an electron beam. Required rotor blades are selected and the rotor disks are equipped with the blades before or after the parts are joined together. The rotor put together from the individual parts is machined in final form. The rotor includes individual rotor parts having associated rotor disks being largely machined in final form and completed grooves for rotor blade roots of a modular system standardizing parts of the rotor and enabling a suitable selection of various thermodynamic and rotor-dynamic requirements. The rotor parts are welded with high power density beam or electron beam weld seams disposed at a greatest possible spacing from a center axis of the rotor.

16 Claims, 3 Drawing Sheets

METHOD OF PRODUCING A TURBINE ROTOR

BACKGROUND OF THE INVENTION

FIELD OF THE INVENTION

The invention relates to a rotor for a turbine, particularly a steam turbine, including individual rotor parts being welded together to make a unit, and to a method for producing the turbine rotor.

The rotor of a turbine used to generate electrical power, such as a steam turbine, is subjected to severe strains. In order to withstand them and to nevertheless achieve long service times on one hand while keeping production costs within acceptable limits on the other hand, many possible constructions have been conceived of, all of which have certain advantages but naturally also have disadvantages.

An especially sound but also complicated and expensive production method is to forge a one-piece rotor from a solid block. The procurement of material required for production cannot be done until an order has been received and often involves a long delivery time, which is not in the least due to the fact that the number of available shippers is limited. Moreover, prefabrication independently of orders and parallel machining of individual parts are not possible, resulting in long production times. The use of rotor disk blades also presents difficulties, when it involves axially insertable blade roots, since machining the grooves requires a greater axial spacing between the rotor disks, to enable working with suitable tools. However, wide spacings between the rotor disks worsen the rotor dynamics.

Another construction makes it possible to produce suitable rotors with separate, shrink-fitted-on rotor disks. However, in the shrinking process, additional strains arise in the rotor, and moreover there is the danger of corrosion from friction at the joints. It is also known to screw together disks that mesh with one another through a tie rod, but that is not unproblematical either, since over the long term loosening of the screwed connection must be expected.

Some of those disadvantages can be averted by forming individual rotor segments and then welding them together to a unit that forms the rotor. Such rotors are known, for instance, from the BBC Corporate Publication entitled "Geschweißte Rotoren für Dampfturbinen" [Welded Rotors for Steam Turbines], Publication No. CH-T 060 072 D, and from German Published, Non-Prosecuted Applications DE 22 35 961 Al and DE 25 22 277 Al. However, the disadvantages of rotors of that type are that conventional welding techniques are employed and that since the individual segments are merely premachined parts, extensive post-machining is required.

That means that the rotor must be machined in final form in the form of a large, heavy single piece, as in the case of a rotor forged from the solid block. The segmentation and further provisions are intended to make the rotor lighter.

SUMMARY OF THE INVENTION

It is accordingly an object of the invention to provide a turbine rotor and a method for producing the same, which overcome the hereinafore-mentioned disadvantages of the heretofore-known methods and devices of this general type and which enable easy production with a short processing time.

With the foregoing and other objects in view there is provided, in accordance with the invention, a method for producing a rotor of a turbine, particularly a steam turbine, from individual rotor parts being welded together to make a unit, which comprises assembling parts of a rotor required for a given turbine in a modular system having supply steam shaft ends, single rotor disks, double rotor disks, exhaust steam shaft ends and optionally condensation-end-stage drums, for producing various rotor variants; producing the parts of the rotor at parallel times according to orders and/or taking the parts of the rotor from stock; minimizing still required remachining of the assembled rotor during production of the parts, in particular machining grooves in final form for receiving rotor blade roots; joining the parts together with low warping with a beam of high power density, preferably an electron beam; selecting required rotor blades, and equipping the rotor disks with the blades before or after the parts are joined together; and final-form machining the rotor put together from the individual parts.

With the objects of the invention in view, there is also provided a rotor of a turbine, particularly a steam turbine, including individual rotor parts being welded together to make a unit, comprising individual rotor parts including associated rotor disks being largely machined in final form and completed grooves for rotor blade roots of a modular system standardizing parts of the rotor and enabling a suitable selection of various thermodynamic and rotor-dynamic requirements, the rotor parts being welded with high power density beam or electron beam weld seams disposed at a greatest possible spacing from a center axis of the rotor.

By constructing a modular system made up of standardized rotor parts, machining the individual parts largely to final condition, and using electron beam welding in joining the rotor parts, it is possible to create forged disks as stock items using bar material and as a result to achieve shorter shipping times with a greater selection of shippers. The prefabrication can be independent of orders to a large extent and can be done with parallel machining of the individual elements on relatively small machine tools with a shortened processing time. The simplified, stable individual parts enable numerical control (NC) production. The largely finally machined rotor parts only have a small size at the most important fitting points, while plane surfaces, the grooves of the rotor blade root, are machined in finished form, so that after radial welding with the electron beam and ensuing heat treatment, the final machining is limited to the final lathe-turning of the remaining fits. The supply steam shaft end can be machined in final form except for the bearing points, the compensating pistons, and optionally the blade fastening. The exhaust steam shaft end can be machined in final form except for the bearing points and the coupling connection, and the rotor disks can be machined in final form except for the outside diameter in the weld seam region. Alternatively, the rotors may also be produced complete in the form of cast parts, and powdered metal can also be used.

Another essential advantage of the method of the invention is that it is possible to build especially compact, short rotors with even better dynamic properties because of the reduced weight. Since the largely finally machined rotor disks are also already provided with the grooves required for equipping them with blades, when their mutual spacing is specified there is no longer any need to make sure that the spacing is big enough to afford sufficient room for maneuvering of suitable tools for machining the grooves.. The spacing of the joined-together rotor disks can accordingly be minimized for the sake of rotordynamics.

In accordance with another feature of the invention, the individual rotor disks or all of them are equipped with blades and optionally balanced as well before they are welded together. The possibility also exists of putting the rotors together from parts made of different materials, for the sake of better utilization of material and adaptation to operating conditions.

A double rotor disk has proved to be an especially advantageous rotor part belonging to the modular system, because with such a rotor part the modularizing can be optimized. By combining two rotor disks to make one double rotor disk, high stability of the component is assured on one hand, and good accessibility is attained on the other hand, particularly for machining the grooves for the root parts of the blades, and moreover the number of weld seams is reduced as compared with single disks. In the same way as the tools can be brought to the grooves from outside on both sides, the blades can also be conveniently inserted by their blade root axially into the suitably shaped grooves.

In accordance with a further feature of the invention, the rotor parts have an axial bore that serves to receive an axial tie rod that holds the parts together, so that they can be joined together by electron beam welding.

The modular system constructed for the production of a rotor includes not only the double rotor disks already mentioned but also single rotor disks, supply steam shaft ends, exhaust steam shaft ends, and condensation-end-stage drums.

In accordance with an added feature of the invention, in order to economize on material on one hand but also to facilitate the electron beam welding on the other hand, a recess is provided in the rotor parts, at least unilaterally, symmetrically with the central axis. This creates an annular cuff that is symmetrical with the axis. The cuff rests on the adjacent rotor part and defines the location of the weld seam.

In steels with high mechanical strength, in particular those with a relatively high content of carbon and/or nickel, it is more difficult to produce good weld seams. In order to eliminate this problem, in accordance with an additional feature of the invention, the annular cuff is produced from a material that is more easily welded, preferably a steel with a lower carbon and/or nickel content, as compared with other regions of the rotor part. This can be achieved by suitable processing methods, such as vacuum melt-down or slag smelting.

Alternatively, in accordance with yet another feature of the invention, the region of the rotor disks located remote from or facing away from the center axis and to which the blades are secured, is produced from a steel with higher mechanical strength. The annular cuff and possibly the remainder of the rotor disk can be produced from a material that is readily weldable.

In accordance with another feature of the invention, in order to counteract any reduction in strength in the region of the weld seams, there are provided sets of teeth on the outer region of the rotor parts located toward the center axis; these teeth mesh with corresponding sets of teeth in the adjacent rotor part. These sets of teeth can absorb at least some of the forces of rotation, thereby providing relief for the weld seams.

In accordance with a concomitant feature of the invention, the teeth are produced from a steel of higher mechanical strength.

Other features which are considered as characteristic for the invention are set forth in the appended claims.

Although the invention is illustrated and described herein as embodied in a turbine rotor and a method for producing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
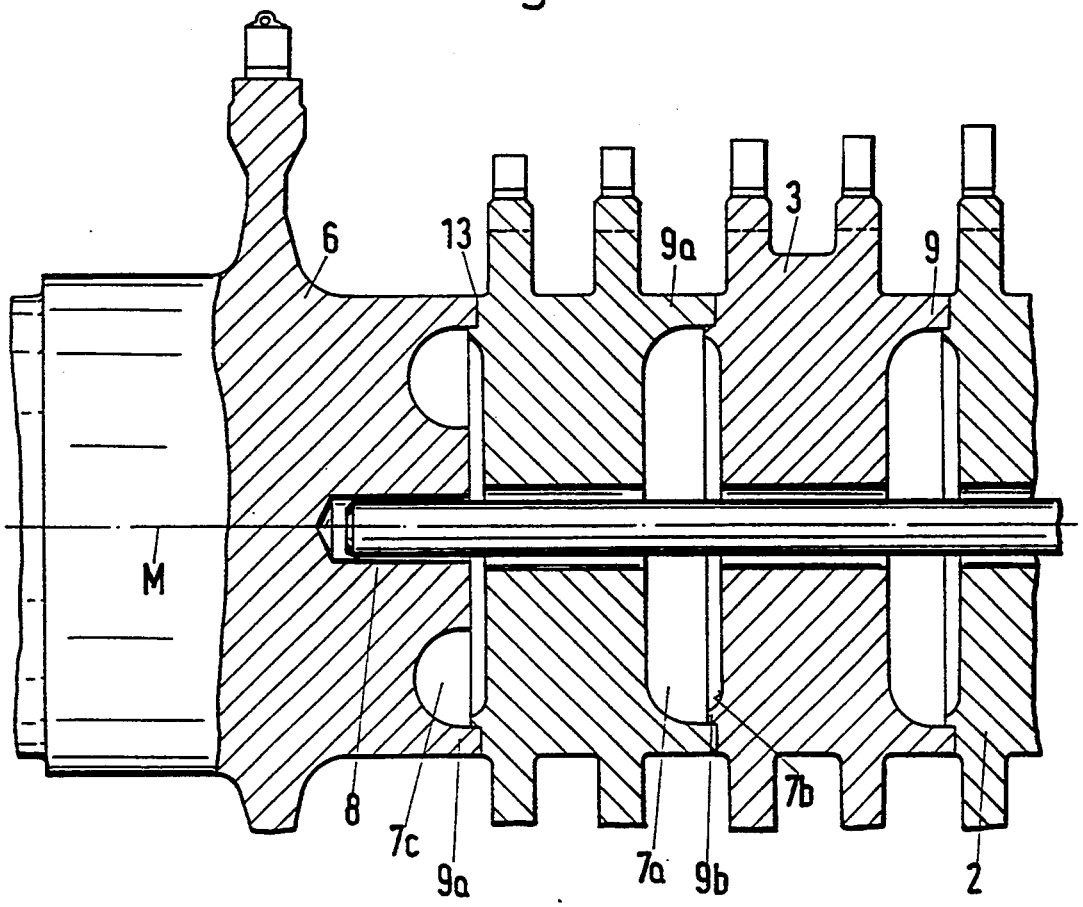
FIG. 1 is a fragmentary, diagrammatic, lateral-sectional view of a welded steam turbine rotor.
Figure 2:
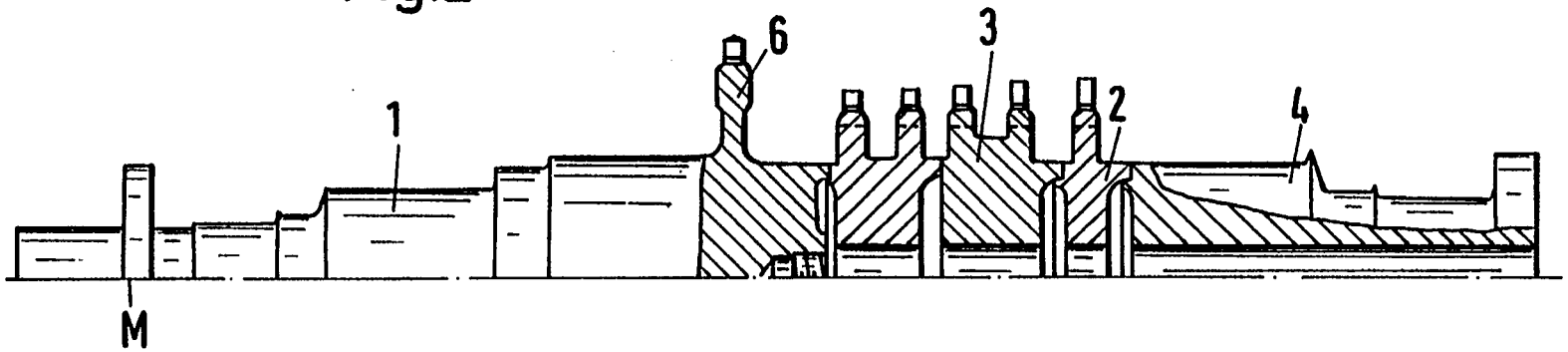
FIG. 2 is a partially sectional, elevational view of a first variant of an upper half of a steam turbine rotor.
Figure 3:
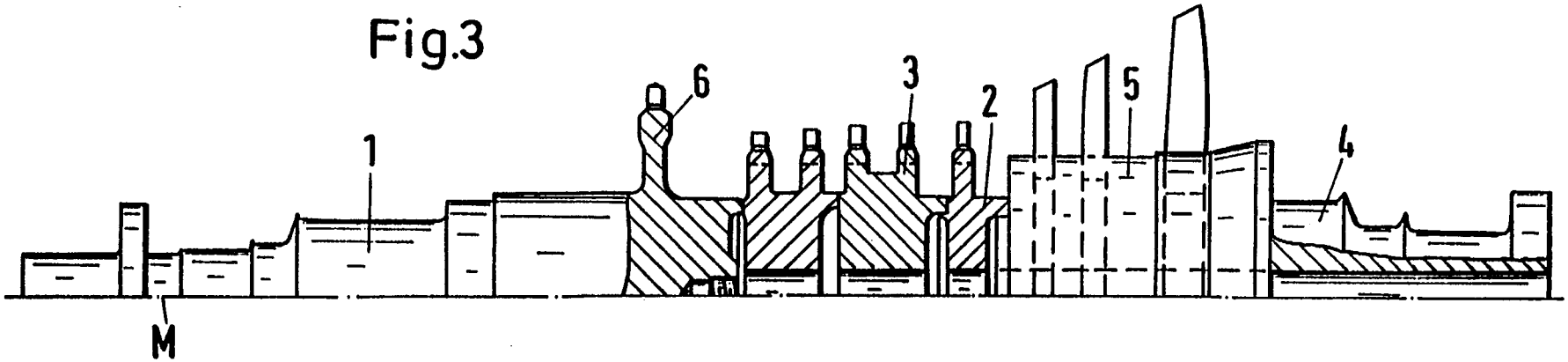
FIG. 3 is a partially sectional, side-elevational view of a second variant of an upper half of a steam turbine rotor, as in FIG. 1.

Referring now to the figures of the drawing in detail and first, particularly, to FIG. 1 thereof, there is seen a portion of a rotor which corresponds to a portion shown in FIG. 2. Accordingly, the rotor in this version includes a supply steam shaft end 1, two double :rotor disks 3, one single rotor disk 2, and an exhaust steam shaft end 4. A control wheel 6 is part of the steam shaft end 1, but it may also be subdivided even further. In addition to the rotor parts 1–4 already mentioned above, the rotor of FIG. 3 includes a condensation-end-stage drum 5.

In a manner which is symmetrical with respect to a central axis M, the rotor parts 1–5 are provided with various recesses *7a*, *7b*, *7c*, which provide for the creation of annular cuffs 9*a*, 9*b*, that fit over one another and thus effect a concentric alignment relative to the axis.

All of the rotor parts have an axial bore, through which a tie rod 8 is guided. The tie rod 8 is screwed into the supply steam shaft end 1 and holds the rotor parts 1–5 together. Weld seams 13 made by electron beam welding can then be located at places where the annular cuffs 9*a* meet the adjacent rotor parts. The weld seams 13 assure the joining together of the rotor parts 1–5 to make a single rotor.

Figure 4:
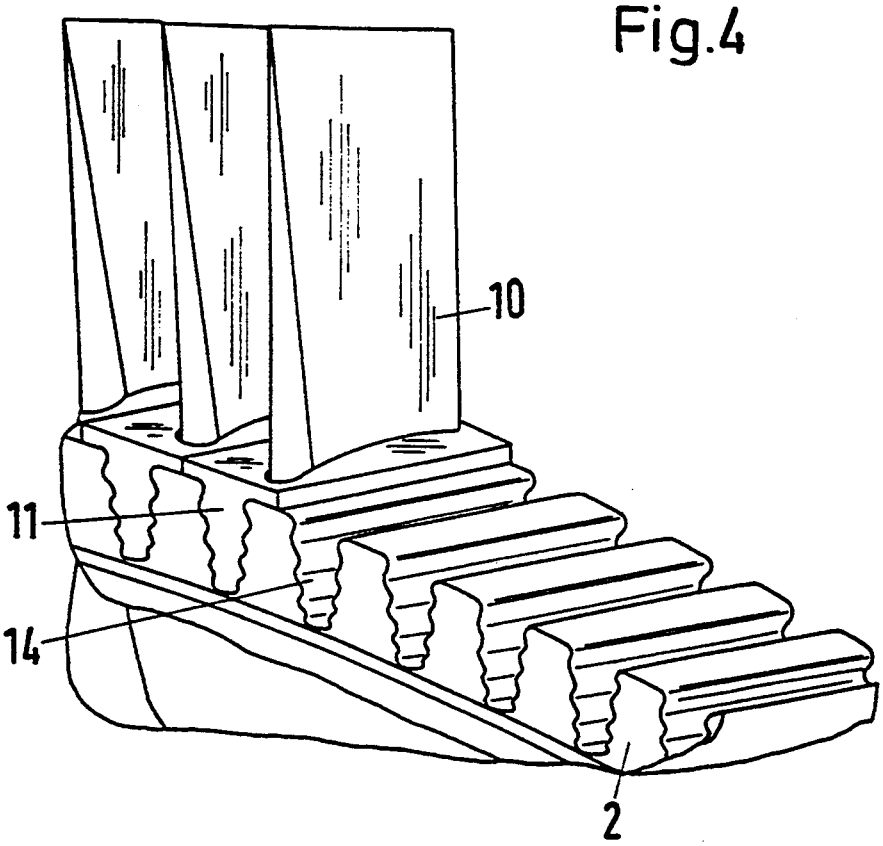
FIG. 4 is a fragmentary, perspective view of a rotor disk, having axial grooves and being partly equipped with blades.
Figure 5:
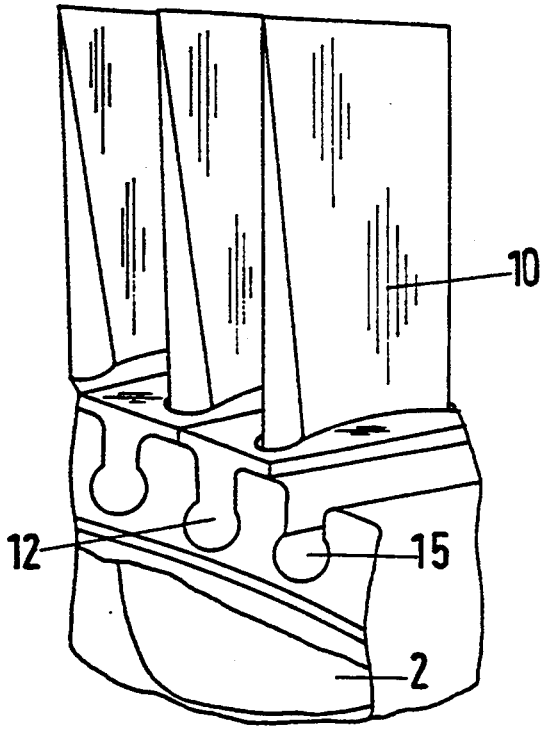
FIG. 5 is a view corresponding to FIG. 4, with different axial grooves.

By modularizing the rotor, tools required to cut the grooves can be conveniently brought into position from the outside, for both the single rotor disks 2 and the double rotor disks 3. This makes it possible to achieve arbitrarily different groove shapes, such as those shown in FIGS. 4 and 5, and to insert blades 10 axially into grooves 14, 15 in the rotor disk 2 by blade roots 11 and 12 thereof.

Thus this disk construction makes any type of blade fastening possible, and its production can be carried out in a simple way by using smaller machine tools. Processing with welded-on blades or complex rotor disks of powdered metal is likewise possible. Very short processing times are attainable as a result of parallel machining.

No attempt has been made to show the sets of teeth between the rotor parts that relieve the weld seams, because they are conventional embodiments which are familiar to one skilled in the art.

We claim:

1. A method for producing a rotor of a turbine from individual rotor parts being welded together to make a unit, which comprises: assembling parts of a rotor required for a given turbine in a modular system having supply steam shaft ends, single rotor disks, double rotor disks, and exhaust steam shaft ends, for producing various rotor variants;

machining grooves in final form for receiving rotor blade roots for minimizing still required remachining of the assembled rotor during production of the parts;

subsequently joining the parts together with low warping with an electron beam;

selecting required rotor blades, and equipping the rotor disks with the blades; and final-form machining the rotor put together from the individual parts.

2. The method according to claim 1, which comprises producing the parts of the rotor at parallel times according to orders.

3. The method according to claim 1, which comprises taking the parts of the rotor from stock.

4. The method according to claim 1, which comprises producing the parts of the rotor at parallel times according to orders and taking the parts of the rotor from stock.

5. The method according to claim 1, which comprises assembling condensation-end-stage drums with the parts of the rotor.

6. The method according to claim 1, which comprises equipping the rotor disks with the blades before the parts are joined together.

7. The method according to claim 1, which comprises equipping the rotor disks with the blades after the parts are joined together.

8. The method according to claim 6, which comprises balancing at least one of the rotor disks.

9. The method according to claim 1, which comprises disposing an axial tie rod in an axial bore formed in the rotor parts to be joined together by electron beam welding, for holding the parts together during the joining strap.

10. The method according to claim 1, which comprises forming the parts together with high power density beam weld.

11. The method according to claim 1, which comprises making the parts of different materials.

12. The method according to claim 1, which comprises forming at least one of the rotor disks as a double rotor disk.

13. The method according to claim 1, which comprises forming a recess in the rotor parts being symmetrical with respect to the center axis on at least one side, forming an annular cuff resting on an adjacent rotor part and defining a location of the weld seam.

14. The method according to claim 13, which comprises forming the annular cuff of a material which is more easily welded than other regions of the rotor parts.

15. The method according to claim 14, which comprises selecting the material from the group consisting of a steel with a lower carbon content and a steel with a lower nickel content.

16. The method according to claim 13, which comprises at least partially equipping at least one of the rotor disks with blades, defining on the rotor disks an outer region disposed farther from the center axis, securing the blades to the outer region, and forming the outer region of a steel of higher mechanical strength than other regions of the rotor disk.

* * * * *